US009386843B2

(12) United States Patent
Grez et al.

(10) Patent No.: US 9,386,843 B2
(45) Date of Patent: Jul. 12, 2016

(54) ADJUSTING BRUSHHEAD FOR FACIAL CONTOURS

(71) Applicant: L'Oreal, Paris (FR)

(72) Inventors: Joseph Grez, North Bend, WA (US); Zane Bowman Allen Miller, Seattle, WA (US)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/452,196

(22) Filed: Aug. 5, 2014

(65) Prior Publication Data

US 2016/0037902 A1 Feb. 11, 2016

(51) Int. Cl.

| | |
|---|---|
| ***A46B 7/08*** | (2006.01) |
| ***A46B 13/02*** | (2006.01) |
| ***A46B 13/00*** | (2006.01) |
| ***A46B 9/02*** | (2006.01) |

(52) U.S. Cl.

CPC ..... *A46B 13/008* (2013.01); *A46B 9/02* (2013.01)

(58) Field of Classification Search

CPC ..... A46B 7/06; A46B 7/08; A46B 13/008; A46B 13/02; A61H 7/002–7/005

USPC ..... 15/21.1, 22.1, 22.4, 28, 179, 180, 201

See application file for complete search history.

(56) References Cited

U.S. PATENT DOCUMENTS

| | | | | |
|---|---|---|---|---|
| 7,386,906 | B2 | 6/2008 | Roth et al. | |
| 8,484,788 | B2 | 7/2013 | Brewer | |
| 2003/0079305 | A1* | 5/2003 | Takahata | A61C 17/3472 15/22.1 |
| 2007/0124936 | A1* | 6/2007 | Okabe | B26B 19/14 30/43.6 |

FOREIGN PATENT DOCUMENTS

| | | | |
|---|---|---|---|
| JP | 3-280911 | * 12/1991 | A47K 7/04 |

* cited by examiner

*Primary Examiner* — Laura C Guidotti

(74) *Attorney, Agent, or Firm* — Clark A. Puntigam; Jensen & Puntigam, P.S.

(57) ABSTRACT

An adjusting brushhead includes a base assembly which is removably connectable to an electric skin care appliance. The brushhead also includes an inner brush assembly which oscillates in operation by a drive member with motor action. The brushhead further includes an outer brush assembly which is mounted to the base assembly by mounting elements, permitting the outer brush assembly to move in accordance with facial contours.

7 Claims, 7 Drawing Sheets

ADJUSTING BRUSHHEAD FOR FACIAL CONTOURS

TECHNICAL FIELD

This invention relates generally to electric skin care appliances having a moving brushhead, and more particularly concerns such a brushhead which is capable of adjusting to facial contours.

BACKGROUND OF THE INVENTION

A conventional oscillating skin care device, such as shown in U.S. Pat. No. 8,484,788, includes a replaceable brush assembly having inner and outer brush portions. The inner brush portion is oscillated at a selected frequency, while the outer brush portion remains fixed in position, with both brush portions having upper surfaces which terminate in a single plane.

Users must reposition the appliance frequently so that the upper surfaces of the brush portions contact the surface of the portion of the face being treated. This can be either difficult or inconvenient at times, so that the overall treatment of the facial area can be compromised.

Accordingly, it is desirable to have a brushhead arrangement capable of effective treatment of the facial contours by adjusting to such contours.

SUMMARY OF THE INVENTION

Accordingly, an adjusting brushhead for a skin care appliance comprises: a base member removably connected to a head portion of a skin care appliance; an inner brush assembly which is driven by a driving member and is connected to the base member in a manner such that it is removable with the base member; and an outer brush assembly, which is positioned around the inner brush member, the outer brush assembly being flexibly mounted to the base member so that the outer brush assembly moves in response to contact with facial contours.

BEST MODE FOR CARRYING OUT THE INVENTION

Figure 1:
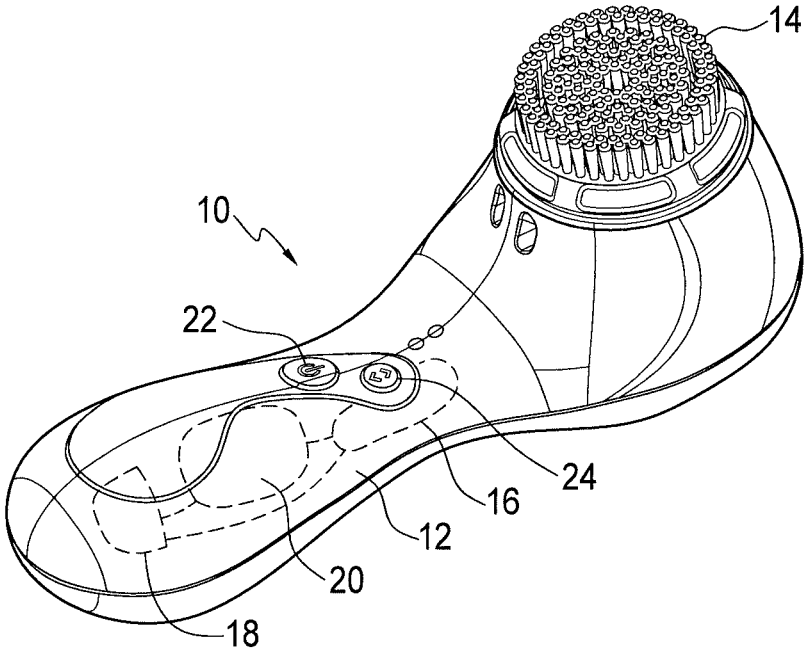
FIG. 1 is a schematic view of a skin brush appliance.

FIG. 1 shows an electric skin brush appliance generally at 10. The appliance includes a handle 12 and a removable brushhead 14. The arrangement and configuration of the brushhead 14 relative to a drive member of the appliance is shown and described in more detail below. Within handle 12 and represented representationally for clarity are the general operating elements of the appliance, including a drive motor assembly 16, which is powered by a rechargeable battery 18. The operation of the appliance is controlled by a microprocessor/controller 20. The appliance includes an on/off button 22 and a power mode control button 24. The appliance of FIG. 1 is designed to operate at sonic frequencies, typically in the range of 166-186 Hz, oscillating the brushhead portion 14 back and forth rotationally within an amplitude range of 6°-12°. The appliance shown in FIG. 1 is an example of the structure and operation of one skin brush appliance; the structure, operation frequency and oscillation angle of such an appliance can be varied while utilizing the brushhead of the present invention.

Figure 2:
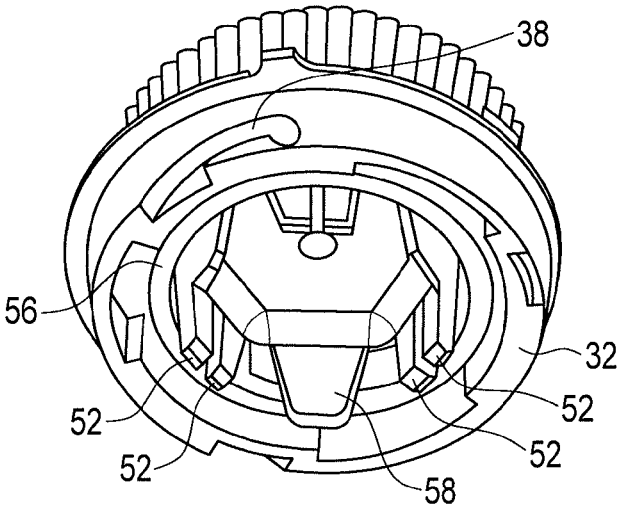
FIG. 2 is a schematic view showing the structural connection between several portions of the prior art brushhead of FIG. 2.
Figure 3:
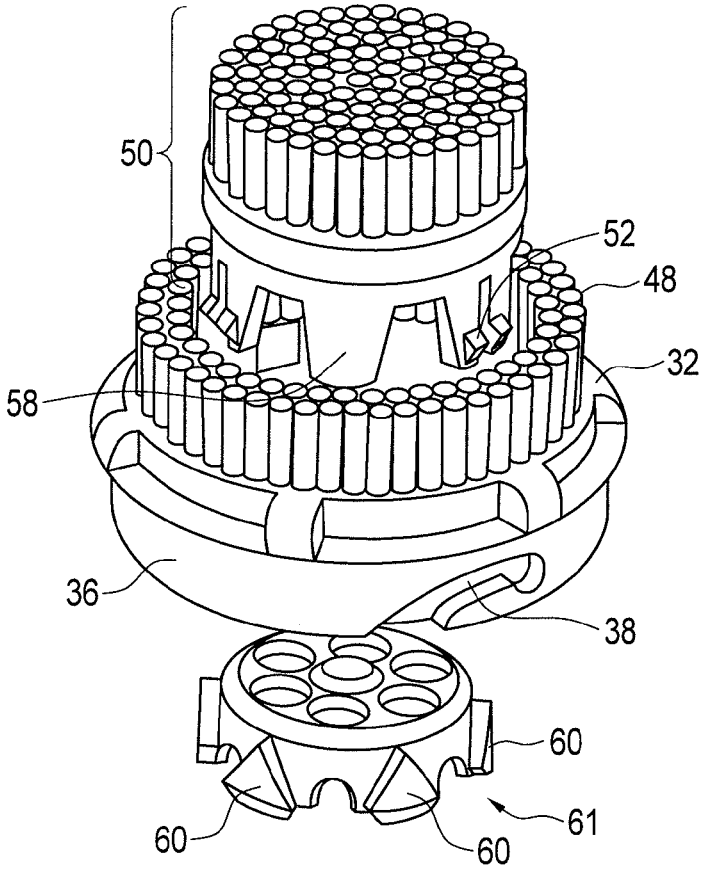
FIG. 3 is an exploded view of a prior art brushhead arrangement, some structural aspects of which are in the present brushhead.

FIGS. 2 and 3 show a brushhead structure having features which are used in the several embodiments of the present brushhead. This brushhead is shown and described in U.S. Pat. No. 7,286,906, which is owned by the assignee of the present invention, the contents of which are incorporated by reference herein. A summary description of FIGS. 2 and 3 is included below.

Figure 4:
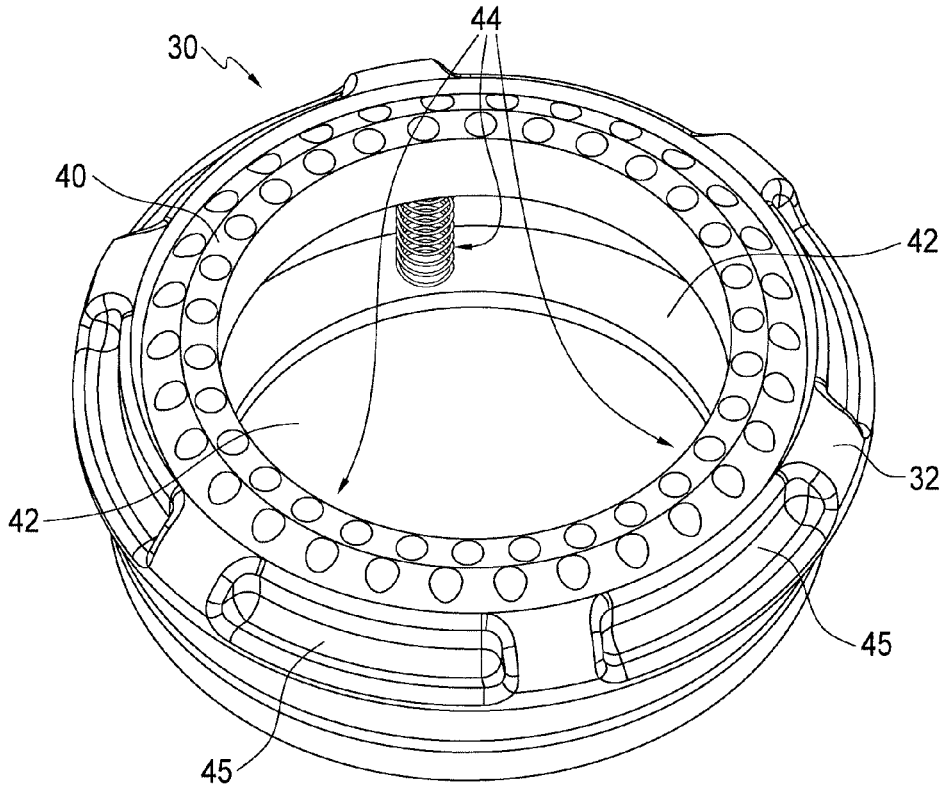
FIGS. 4 and 5 are isometric and cross-sectional views, respectively, showing one embodiment of the present adjustable brushhead invention.
Figure 5:
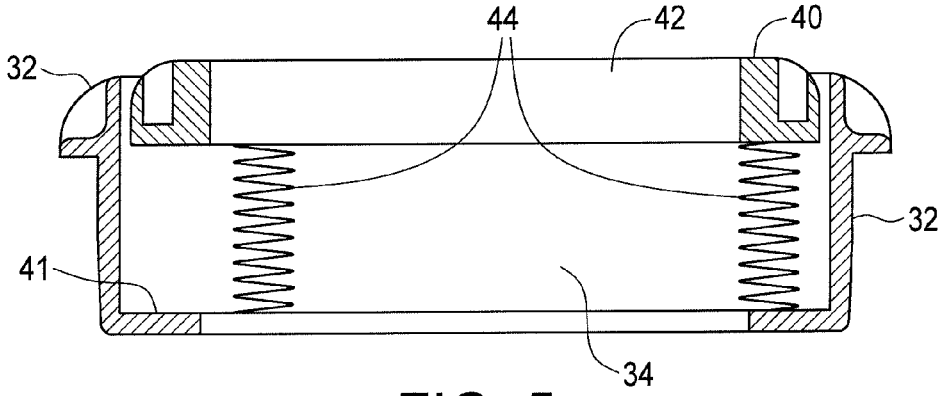

FIGS. 4 and 5 show one embodiment of the new brushhead. The configuration and structural arrangement of the brushhead shown is designed to provide a brush surface which is designed to adjust to and accommodate facial contours during operation of the appliance. The brushhead, shown generally at 30, includes a base assembly 32. Base assembly 32 is annular, with an outside diameter of approximately 50 mm and a central opening 34. The base assembly includes an exterior surface 36 having a plurality of grooves 38 (FIG. 3) which in one embodiment are separated by 120°. Matching pins (not shown) on the inner surface of a boundary wall defining an opening for the brushhead assembly in the appliance provides a mating relationship between the brushhead assembly and the appliance, similar to that shown in the '906 patent. The base assembly 32 remains fixed in the appliance during operation of the appliance, but is removable from the appliance.

Figure 6:
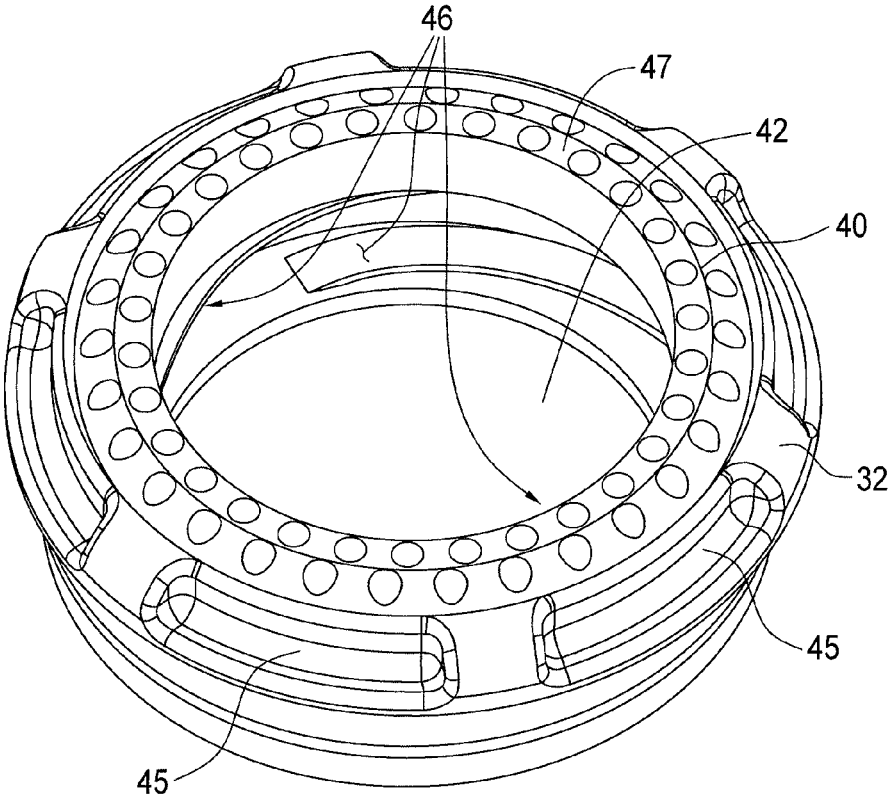
FIGS. 6 and 7 are isometric and cross-sectional views, respectively, of a variation of the embodiment of FIGS. 4 and 5.
Figure 7:
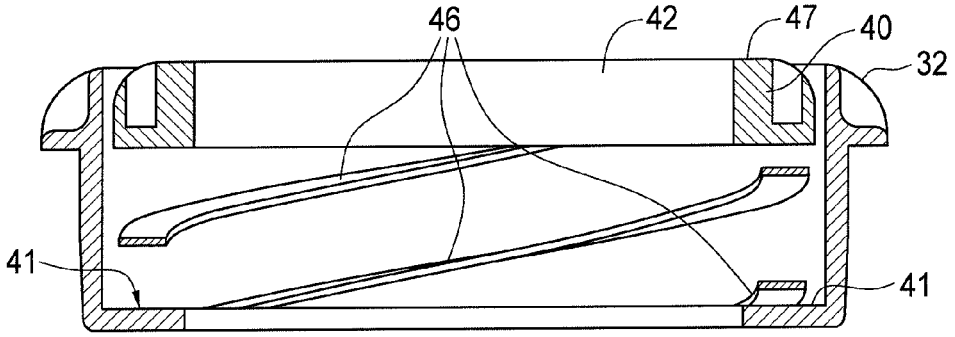

Positioned concentrically within annular opening of the base assembly 32 is an outer ring member 40. Outer ring member 40 is also annular, having an exterior diameter of 42 mm and a central opening 42. The outer ring 40 is connected to the base assembly by a plurality of springs, in one example, three springs 44 spaced 120° apart, although additional springs can be used, with different spacing. The springs 44 can be of various configurations. FIGS. 4 and 5 show coil springs, while FIGS. 6 and 7 in another embodiment show flat springs 46, spaced apart 120°. The embodiment of FIGS. 6 and 7 is otherwise the same as the embodiment of FIGS. 4 and 5. While three springs are shown in the embodiment of FIGS. 6 and 7, other embodiments can have a different number of springs, including two, four or even more, spaced around the brushhead assembly. Other springs can also be used, including bent metal and elastomer springs.

Typically, the outer ring 40 will be positioned by the springs approximately 8 mm above the lower surface 41 of the base assembly in both embodiments, as appropriate to ensure that the filaments in the ring 40 are in a plane with those of the moving brushhead when at rest. The base assembly typically includes a number of spaced finger grips 45 (see again FIGS. 2, 4, 5, 6 and 7), which allow the user to remove and insert the entire brushhead assembly from and into the appliance. Extending from the upper surface 47 of the outer ring 40 are one or more rings of bristles 48 (such as shown in FIG. 3). Openings therefore are shown in the embodiments of FIGS. 4, 5 and 6, 7. Bristles 48 in the outer rings are conventional but remain fixed in position during operation of the appliance, since the base assembly 32 to which the outer ring is attached remains fixed in position.

Referring now specifically to FIGS. 2 and 3, the present brushhead further includes an inner brush portion 50 (not shown in FIGS. 4, 5 and 6, 7 for clarity) which is positioned within the central opening 42 of the outer ring 40. The inner brush portion 50 has a plurality of elements which extend downwardly, including two sets of depending legs. The first set of depending legs 52-52 are spaced at 120° intervals, with each leg comprising a pair of snap portions. The snap portions of each leg are configured so as to grip an inner, lower lip 56 of base assembly 32. The second set of legs 58-58 are drive elements which mate with exterior projections 60 on the outer wall of a drive element 61, which is driven by the appliance motor. The above connecting structure between the inner brush portion and the base assembly in the present brushhead is substantially identical to that shown in the '906 patent. Other drive arrangements can be used. The key structural arrangement of the embodiment of FIGS. 4, 5 and 6, 7 is the outer ring 40 which is supported away from the base member 32 by springs. This allows the outer ring 40 and the inner brush portion attached thereto to move and adjust to the facial contours.

Figure 8:
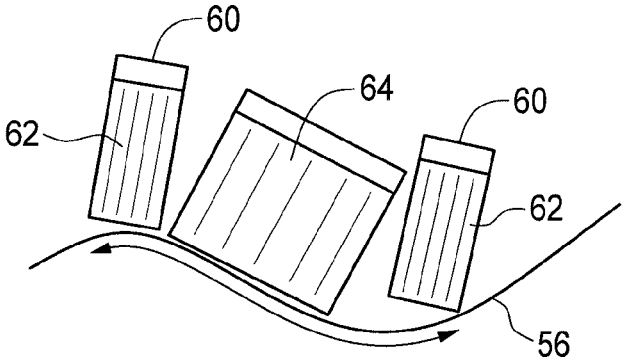
FIG. 8 is a simplified cross-sectional view of the brushhead of FIGS. 4 and 5 positioned on a facial skin contour.

In operation, referring to FIG. 8, as the brushhead is moved over facial contours 56, the outer ring 60 moves with spring action so that outer ring 60 and the bristles 62 thereon generally conform to the various skin contours, while allowing the inner brush portion 64 to perform effective cleaning because the tips of the bristles contact the skin area cleanly and evenly. The appliance thus accommodates the various irregular facial contours while still providing effective cleaning. The inner moving brush portion is smaller in diameter so that misalignment of its bristle plane and the skin surface is more tolerable than is the case for the larger diameter outer ring or bristles.

Figure 9:
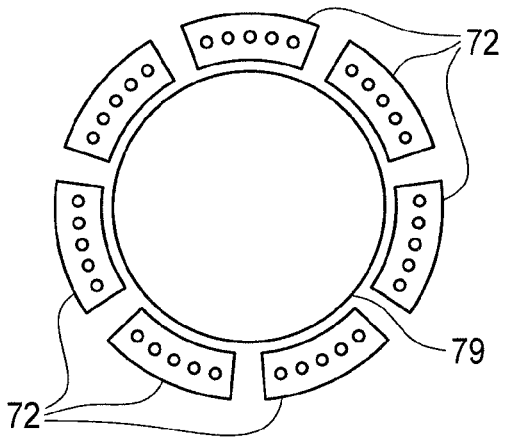
FIGS. 9 and 10 are top and cross-sectional views, respectively, of a variation of the embodiments of FIGS. 4 and 5 and 6 and 7.
Figure 10:
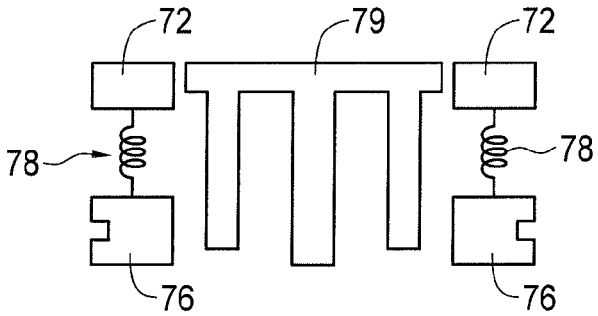

FIGS. 9 and 10 show a simplified top view of an alternative to the embodiment of FIGS. 4-5 and 6-7, in which the outer ring of the brushhead is segmented, i.e. divided into a plurality of individual pieces. FIG. 9 shows a plurality of separate segments 72. In the embodiment shown, there are seven such segments, with each segment separated by a small distance from adjacent segments, e.g. 1 mm. Further, each segment is attached to a base assembly 76 by a separate spring 78. This arrangement permits a more fluid, i.e. extensive, capability of the outer ring segments to adapt to facial contours. The inner brush portion 79 is similar to that of the above embodiments for accomplishing cleansing of the skin.

While the embodiments described above have the ability to move in multiple directions to accommodate facial contours, in a variation thereof, the connections between the outer ring and the base assembly could be telescoping elements or other similar elements which permit movement of the outer ring in only one direction relative to the base assembly, i.e. in and out relative to the base assembly.

Figure 11:
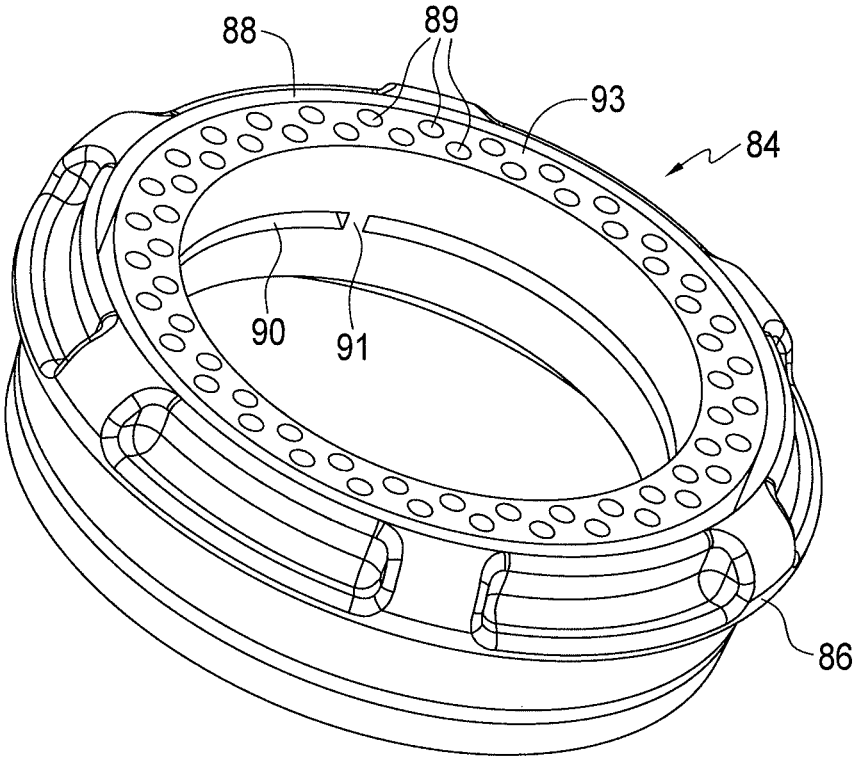
FIG. 11 is an isometric view of another embodiment of the present adjustable brushhead.

FIG. 11 shows another embodiment involving a different arrangement of the moving outer ring. In this embodiment, the brushhead assembly includes a base assembly like the other above-described embodiments, which is removable along with the outer ring and the inner brush member as a unit from the appliance. The brushhead assembly 84 in FIG. 11 includes a base assembly 86, an outer ring 88 with openings 89 for bristles and an inner brush portion (not shown for clarity). In this embodiment, outer ring 88 is in a single gimbal-type relationship with base assembly 86. The gimbal includes two opposing mounting elements, such as hinges, which extend downwardly from opposing portions of the outer ring to an upper surface 90 of the base assembly. One hinge is shown at 91. The other hinge is 180° removed from hinge 90 and is accordingly not shown in FIG. 11. The mounting hinges are typically formed integral with the outer ring and the base assembly, which are separated by a distance of approximately 1 mm between them in the embodiment shown. This spacing provides the capability of the outer ring 88 to rock or swivel about the two opposing mounting elements. Other mounting arrangements could also be used, such as opposing pins, which connect the sides of the outer ring to the base assembly.

In the present embodiment, the range of movement is approximately ±5°, although this can be varied to provide the desired adaptability of the outer ring to the facial contours. As in the other embodiments, the outer ring will include a set of bristles (not shown for clarity) extending from openings 89 into upper surface 93, which bristles can be in the form of rings of bristle tufts or a more random arrangement of bristle tufts. As with the other embodiments, the outer ring is constrained from moving rotationally about a center axis of the brushhead during operation of the appliance by the connecting structure described above, since the base assembly does not move rotationally. However, it has the advantages of the other embodiments of adapting its position relative to the contours of the facial skin.

Figure 12:
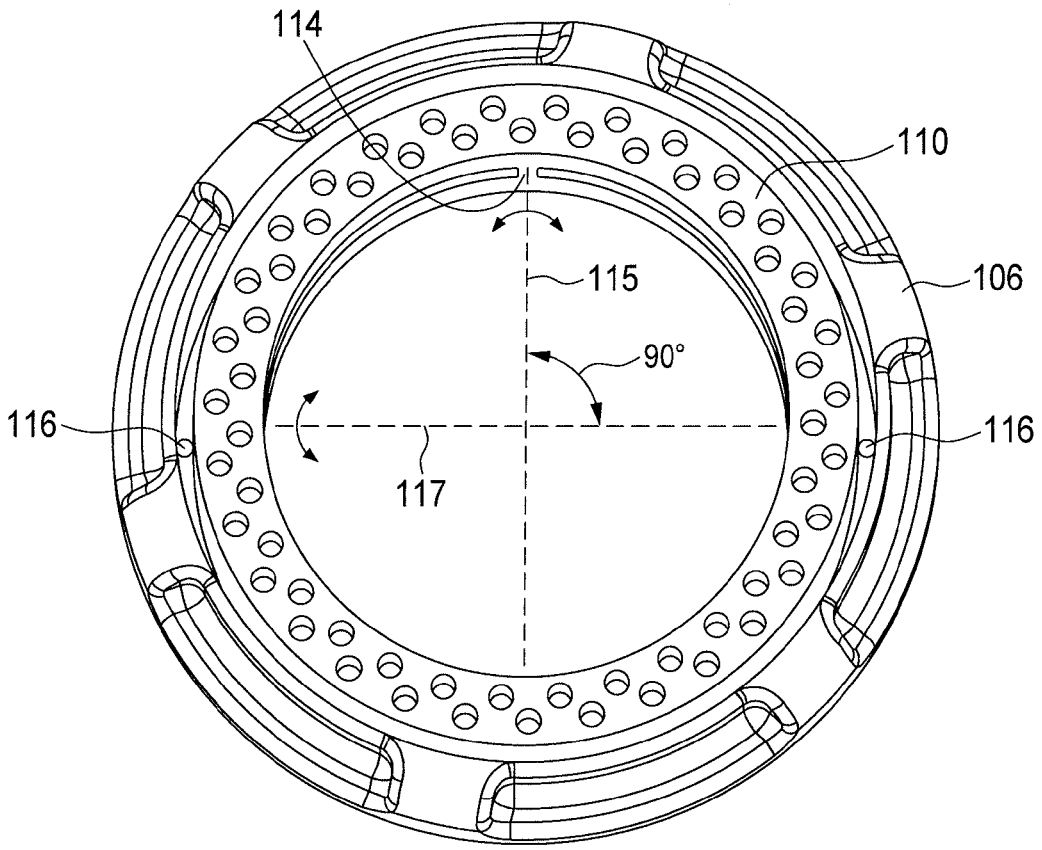
FIGS. 12 and 13 are isometric and cross-sectional views, respectively, of a further embodiment of the present brushhead.
Figure 13:
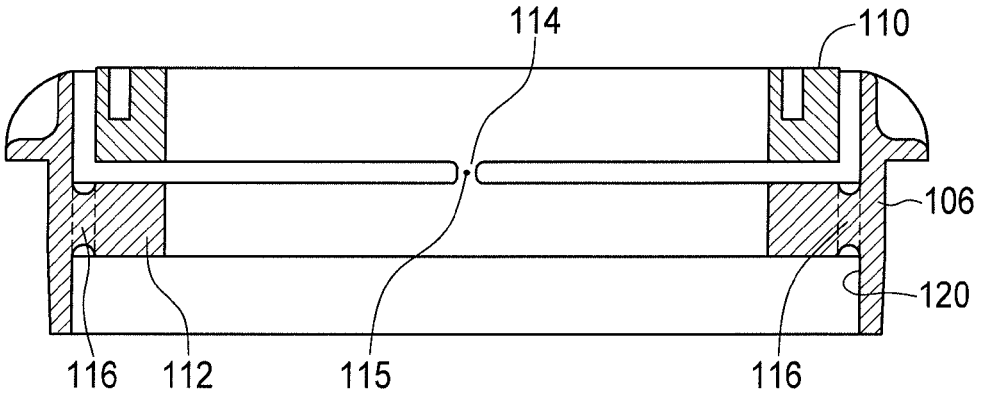

FIGS. 12 and 13 show still another embodiment for the adapting brushhead, specifically a double gimbal arrangement. The brushhead includes a base assembly 106 and an inner brush portion (not shown for clarity), similar to that for the other embodiments. The entire brushhead can be removed (and inserted) in a unitary manner, with the inner brush portion being secured to the base assembly so that it maintains its relationship with the base assembly but can oscillate by action of the driving member (FIG. 2).

In this embodiment, there are two outer rings, an upper outer ring 110 and a lower outer ring 112. The upper and lower outer rings are attached in a gimbal arrangement to the base assembly 106. The upper outer ring is mounted to the lower outer ring by opposing hinges 114, only one of which is shown, so that the upper outer ring rocks or pivots about axis 115 normal to the brushhead axis. The upper outer ring rocks through an angle in the range of ±5°. The lower outer ring 112 is mounted by opposing hinges 116 to the base assembly 106, extending between a side edge of the lower outer ring and the interior surface 120 of the base assembly. Each opposing hinge 116 is positioned 90° from a hinge 114. Hinges 116 can be made integral with the lower outer ring and the base assembly. The lower outer ring thus rocks or swivels about an axis 117 which is 90° from axis 115, through an angle of ±5°.

Bristles (not shown) are positioned on the upper outer ring and extend upwardly therefrom, with the tips of the bristles being in the same plane as the tips of the bristles from the inner brush member when the upper and lower outer rings are both at rest at a zero angle. While the double gimbal embodiment of FIGS. 12 and 13 show upper and lower outer rings, which are substantially identical except for the respective hinge arrangements, it should be understood that there could be an alternative double gimbal embodiment, with two conventional outer rings, with an inside outer ring being hinge-mounted to the outside outer ring and the outside outer ring hinge mounted to the base assembly. One or both of the outer rings could have bristles.

Thus, with the embodiment of FIGS. 12 and 13, for the facial skin areas which are relatively flat, the bristles on the upper outer ring make contact with the skin, while the inner brush member oscillates to provide cleansing. As the facial contours become irregular, the upper and/or the lower outer rings pivot or rock to accommodate the skin contour, while the inner brush member performs the desired cleaning. As with the other embodiments, the outer rings do not oscillate with the inner brush member, but remain fixed rotationally.

Accordingly, a brushhead has been disclosed which includes an oscillating inner brush member for skin cleansing and an outer ring assembly which is moveable to accommodate variations in facial skin contours.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. An adjusting brushhead for a skin care appliance, comprising:

a base member removably connected to a head portion of a skin care appliance;

an inner brush assembly which is driven by a driving member and is connected to the base member in a manner such that it is removable with the base member;

an outer brush assembly, which is positioned around the inner brush member, the outer brush assembly being flexibly mounted to the base member so that the outer brush assembly moves in response to contact with facial contours, wherein the outer brush assembly is segmented, with each segment being individually spring-connected to the base member.

2. The brushhead of claim 1, wherein the inner brush assembly is driven in an oscillating manner.

3. The brushhead of claim 1, wherein the outer brush assembly includes bristles which extend upwardly therefrom, having tips which are in the same plane as tips of the inner brush assembly when the appliance is at rest.

4. An adjusting brushhead for a skin care appliance, comprising:

a base member removably connected to a head portion of a skin care appliance;

an inner brush assembly which is driven by a driving member and is connected to the base member in a manner such that it is removable with the base member; and an outer brush assembly, which is positioned around the inner brush member, the outer brush assembly being flexibly mounted to the base member so that the outer brush assembly moves in response to contact with facial contours, wherein the outer brush assembly is gimbled to the base member by two opposing pivot elements, permitting the outer brush assembly to rock or swivel about the pivot elements.

5. An adjusting brushhead for a skin care appliance, comprising:

a base member removably connected to a head portion of a skin care appliance;

an inner brush assembly which is driven by a driving member and is connected to the base member in a manner such that it is removable with the base member; and an outer brush assembly, which is positioned around the inner brush member, the outer brush assembly being flexibly mounted to the base member so that the outer brush assembly moves in response to contact with facial contours, wherein the outer brush assembly is gimbled to the base member by two opposing hinges which are integral with the outer brush assembly and the base member, permitting the outer brush assembly to rock or swivel about the pivot elements.

6. An adjusting brushhead for a skin care appliance, comprising:

a base member removably connected to a head portion of a skin care appliance;

an inner brush assembly which is driven by a driving member and is connected to the base member such that it is removable with the base member; and an outer brush assembly, which is positioned around the inner brush member, the outer brush assembly being flexibly mounted to the base member so that the outer brush assembly moves and responds to contact with facial contours, wherein the outer brush assembly includes an upper outer ring and a separate lower outer ring, wherein the upper outer ring is gimbled to the lower outer ring by two opposing first connecting members, and the lower outer ring is gimbled to the base member by two opposing second connecting members which are positioned 90° from the first connecting members.

7. An adjusting brushhead for a skin care appliance, comprising:

a base member removably connected to a head portion of a skin care appliance;

an inner brush assembly which is driven by a driving member and is connected to the base member such that it is removable with the base member; and an outer brush assembly, which is positioned around the inner brush assembly, the outer brush assembly being flexibly mounted to the base member so that the outer brush assembly moves and responds to contact with facial contours, wherein the outer brush assembly is mounted to the base member, which prevents the outer brush assembly from rotating during operation of the appliance, and wherein the inner brush assembly is connected by supporting portions thereof to the base member so as to prevent the inner brush assembly from coming loose from the brushhead assembly.

* * * * *